US006148455A

United States Patent [19]

Kasem

[11] Patent Number: 6,148,455

[45] Date of Patent: Nov. 21, 2000

[54] METHOD AND APPARATUS FOR CONVERTING A CANOPY CRIB TO A STANDARD CRIB

[76] Inventor: Jean Kasem, 138 Mapleton, Los Angeles, Calif. 90077

[21] Appl. No.: 09/238,484

[22] Filed: Jan. 27, 1999

[51] Int. Cl.[7] ..... A47D 7/00

[52] U.S. Cl. ..... 5/93.1; 5/97; 5/414; 135/96

[58] Field of Search ..... 5/93.1, 97, 414, 5/416; 135/88.02, 117, 119, 96

[56] References Cited

U.S. PATENT DOCUMENTS

| | | | |
|---|---|---|---|
| D. 224,822 | 9/1972 | Lee, Jr. | 5/93.1 X |
| D. 232,279 | 8/1974 | White | D6/392 |
| D. 413,454 | 9/1999 | Kasem | D6/390 |
| 2,820,468 | 1/1958 | Park et al. | 135/96 |
| 2,958,084 | 11/1960 | Kenney | 5/97 X |
| 3,814,058 | 6/1974 | Thompson | 5/414 X |
| 3,821,822 | 7/1974 | Borreggine | 5/414 X |
| 4,004,306 | 1/1977 | Gutner | 5/414 |
| 4,790,340 | 12/1988 | Mahoney | 5/414 X |
| 5,553,336 | 9/1996 | Mariol | 5/93.1 |
| 5,706,533 | 1/1998 | Opheim et al. | 5/414 X |
| 5,862,548 | 1/1999 | Gerhart | 5/97 X |

OTHER PUBLICATIONS

3 Pages from Little Miss Liberty Round Crib Company (LMLRCC) Catalog, dated Jun. 1996.

Assembly Instructions for Standard/Canopy Top Round Wood Crib, LMLRCC, dated Jun. 1996.

Assembly Instructions for Round Crib Bedding Ensemble, Little Miss Liberty of Beverly Hills, dated Jun. 1996.

*Primary Examiner*—Lynne H. Browne
*Assistant Examiner*—Robert G. Santos
*Attorney, Agent, or Firm*—Blakely, Sokoloff, Taylor & Zafman LLP

[57] ABSTRACT

A method for converting a canopy crib to a standard crib. The canopy assembly has a number of canopy legs whose bottom portion removably fits inside respective hollows of the crib assembly. The canopy assembly is removed by pulling the canopy legs from the crib assembly to expose the hollows and then separately covering the hollows with plugs.

24 Claims, 1 Drawing Sheet

METHOD AND APPARATUS FOR CONVERTING A CANOPY CRIB TO A STANDARD CRIB

RELATED APPLICATIONS

The subject matter of this patent application is related to the following U.S. patent applications of Jean Kasem, "CONVERTIBLE CANOPY CRIB" (P007), and "CANOPY ASSEMBLY HAVING UNIVERSAL COMPONENTS FOR DIFFERENT TYPES OF CANOPIES" (P006) which are filed on the same date as this application and which are incorporated by reference herein as if set forth in their entirety herein.

BACKGROUND INFORMATION

1. Field of the Invention

This invention is generally related to cribs and more particularly to converting a canopy crib into a standard crib.

2. Description of the Related Art

Canopy cribs are very popular with couples who wish to have a unique sleeping area for their baby. As compared with a standard crib, the canopy crib has a raised canopy that is suspended over the sleeping area of the baby. The canopy as defined in this disclosure may be of different shapes, such as flat, convex (similar to a dome), concave (sometimes called fluted dome), and cone. Many people prefer the standard crib for a baby boy and the canopy crib for a baby girl. Thus, when a couple initially has a baby girl and elects to purchase a canopy crib, and then subsequently has a baby boy, they may be forced to purchase a separate standard crib for their little boy. Accordingly, to reduce the cost of a crib for such couples who have both a baby boy and a baby girl, there is a need for a canopy crib which can be easily converted into a standard crib, and vice versa. Such a canopy crib should also be cost-efficient to manufacture.

SUMMARY

Accordingly, an embodiment of the invention is directed at a method of converting a canopy crib to a standard crib. The canopy crib includes a canopy assembly that is removably connected to a crib assembly. The canopy assembly has a number of canopy legs that are removably connected to the crib assembly to support the canopy assembly on top of the crib assembly. The crib assembly has a number of respective hollows, where a lower portion of each of the canopy legs removably fits inside one of the respective hollows to support the canopy assembly. The method thus comprises removing the canopy assembly to expose the respective hollows, and then covering the hollows.

These as well as other features and advantages of the various embodiments of the invention can be better appreciated by referring to the drawings, written description, and claims below.

DETAILED DESCRIPTION

As summarized above, an embodiment of the invention is directed at an efficient method of converting a canopy crib into a standard crib. This permits a parent to make only a single purchase for a canopy crib and use the same later on as a standard crib. The procedure to change from canopy to standard will include simply removing the canopy assembly and then covering any exposed hollows that were used to support the canopy assembly. A novel structure for doing so is also disclosed.

Figure 1:
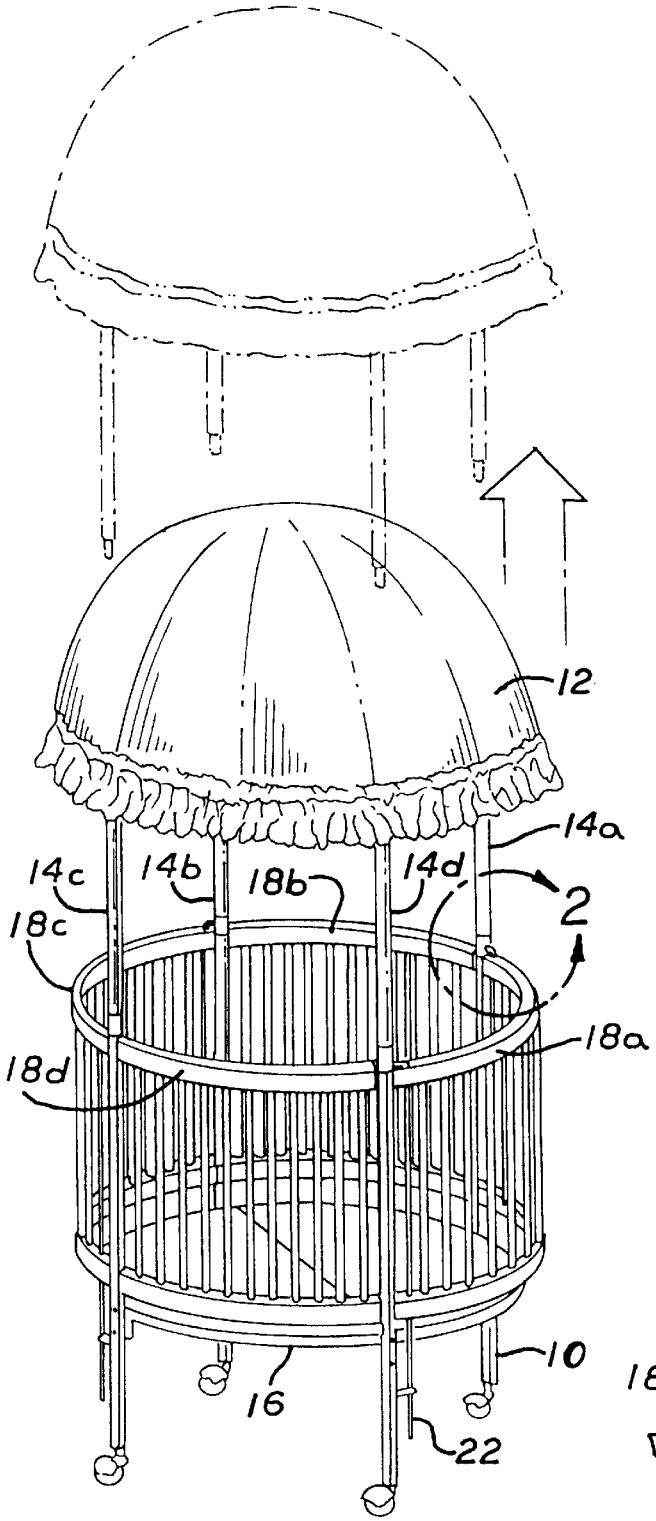
FIG. 1 illustrates a perspective view of a canopy crib conversion technique according to an embodiment of the invention.

FIG. 1 shows a perspective view of a convertible canopy crib according to an embodiment of the invention. A canopy assembly includes a canopy 12 made of cloth or other material that is supported by a frame (not shown), according to conventional techniques. Alternatively, the structure used to support the canopy 12 may be as described in the U.S. Patent Application of Jean Kasem entitled "CANOPY ASSEMBLY HAVING UNIVERSAL COMPONENTS FOR DIFFERENT TYPES OF CANOPIES" (P006), filed on the same date as this application. The canopy 12 is not limited to the dome shape shown but may alternatively be of a variety of different shapes, including flat, concave (so-called fluted dome), or cone. The frame for supporting the canopy 12 can be attached, using well known techniques in the art, to a number of canopy legs 14*a* . . . 14*d*. The canopy legs 14 are in turn removably connected to a crib assembly.

Figure 5:
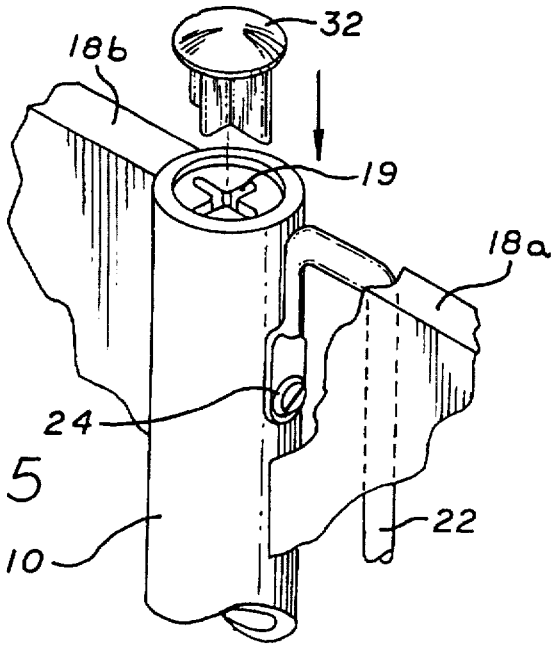
Figure 6:
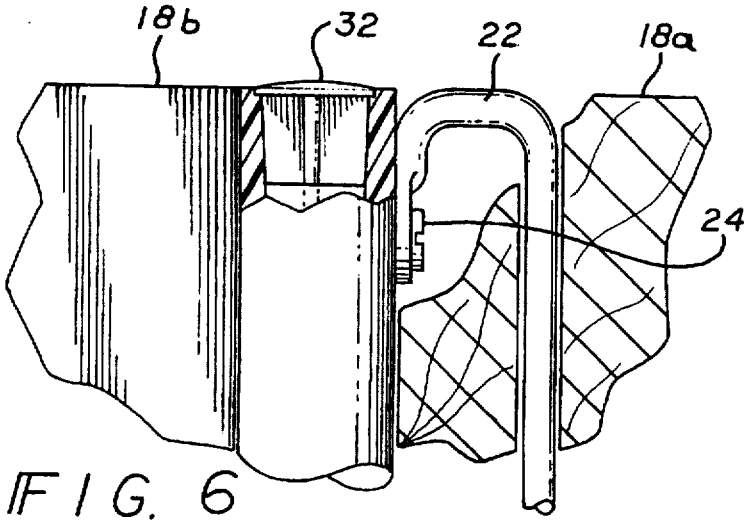

The crib assembly comprises a base 16 surrounded by a number of crib side members 18*a* . . . 18*d* which extend upwards from the base to help contain a baby inside the crib assembly. A mattress (not shown) would also be lying against the base 16. The side members 18 are tall enough such that the baby is not able to crawl outside of the crib. The crib assembly is supported by a number of crib legs 10. The crib assembly can be made according to conventional techniques, such as connecting two adjacent side members 18*a* and 18*b* to a crib leg 10 therebetween, and connecting the base 16 to the four crib legs 10. In addition, the two side members 18*a* and 18*c* opposing each other are movable in a vertical direction, once again as provided by conventional techniques, while the other side members 18*b* and 18*d* are normally fixed. The movable side members when lowered permit the baby to be placed into and removed from the crib without having to lift the baby as high as the top of the crib. In the embodiment shown, each movable side member 18*a* and 18*c* is guided by a pair of rods 22 that extend vertically through on either side of the movable side member. The top portion of the rod 22 is looped to return downwards and connects to a portion of the crib assembly, preferably the crib leg, which is stationary with respect to the movable side members, as shown in FIGS. 5 and 6. A bolt 24 may be used to attach the crib leg 10 to the stationary side member 18*b* through a flat end of the rod 22. There are alternatives to the use of the angled rod 22 that also permit easy access to the child in the crib. For instance, a vertical track attached to the side of the crib leg 10 may be used to allow the side member to slide up and down. An alternative to the rod 22 and the track which are external to the crib leg 10 is a groove formed inside the crib leg. The groove guides a dowel which is attached to the side member and protrudes horizontally to engage the groove. An alternative to the vertically moving side members is to have a top portion of the side member be hinged like a door, allowing a lower access to the inside of the crib after being rotated open.

Figure 2:
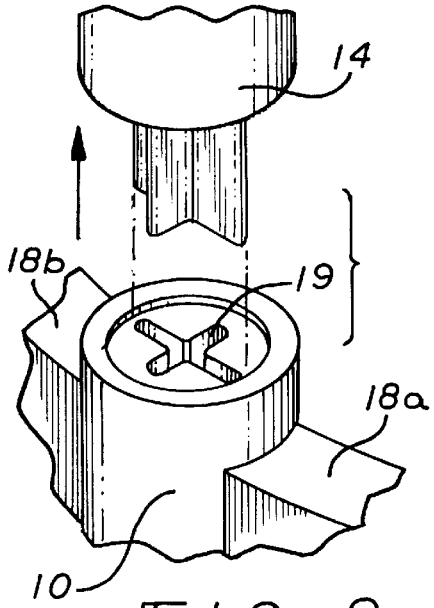
FIG. 2 illustrates a perspective view of the structure for removably supporting a canopy assembly atop a crib assembly.

FIG. 2 shows a perspective view of a means for removably supporting the canopy assembly, according to an embodiment of the invention. The canopy leg 14 terminates with a male mating portion 16 that is sized to fit inside a corresponding hollow 19 in the crib assembly. More specifically, in the embodiment of FIG. 2, the hollow 19 is formed in a single piece being the crib leg 10. Removing the canopy assembly becomes a simple task of pulling the canopy legs 14 vertically upwards away from the crib assembly. Of course, if desired, the canopy 12 and its underlying frame may first be disassembled from the canopy legs 14 in a piece by piece manner, leaving only the canopy legs 14 connected to the crib assembly. Thereafter, each canopy leg 14 may be pulled off its respective crib leg 10. Alternatively, the canopy assembly can be removed as a whole, using two persons, one on either side of the crib, with each person grasping two of the four canopy legs 14 and simultaneously pulling upwards while keeping the crib assembly fixed. The canopy assembly can be remounted by reversing the above steps. It should be noted that to provide a stable canopy assembly, the size of the male mating member 16 and its respective hollow 19 should be selected to provide adequate stability and a tight fit when the canopy assembly has been mounted.

Figure 3:
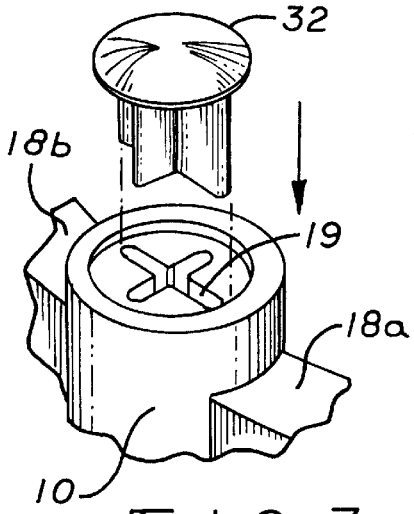
FIG. 3 shows a technique for covering the hollow in a crib assembly.
Figure 4:
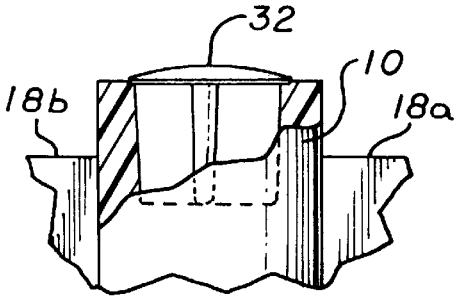
FIG. 4 is a cross-sectional view of a plug which is inserted into the hollow to cover the hollow.

Turning now to FIG. 3, once the canopy assembly has been removed, the hollow 19, which as a result has been exposed, is then covered by, for instance, inserting a plug 32 into the respective hollow 19. Once again, the plug 32 should be sized to fit tightly in the hollow 19. Preferably, the plug 32 once inserted is substantially flush with a portion of the crib assembly that surrounds the respective hollow 19. This may be as in the embodiment shown in FIG. 3, where the plug 32 is essentially flush with the portion of the crib leg 10 surrounding the hollow 19. This is also shown, in cross-section, in FIG. 4. In a preferred embodiment of the invention, the plug 32 once inserted into the hollow 19 cannot be rotated with respect to the region surrounding the hollow 19 on the crib assembly. To achieve this result, the plug 32 and its respective hollow 19 have mating non-circular cross-sections, as shown in FIG. 3. In addition, it is also preferred that once plug 32 has been fully inserted, the plug cannot be removed using bare fingers. Preferably, some type of tool would be required to remove the plug 32 from its hollow 19. Finally, the crib leg 10 and its connection to the adjacent side members 18*a* and 18*b* should be such that the top of the plug 32 once fully inserted into the hollow 19 extends no more than ⅛" above the side members when the canopy assembly has been removed.

The various components of the canopy assembly described above can be manufactured in a low cost manner using injection molded or extruded plastic, although other more exotic materials may alternatively be used. In addition, the components of the canopy assembly described above may be sold as a kit together with instructions to connect the different components together using various different types of fasteners and attachment techniques.

To summarize, a novel technique for converting a canopy crib to a standard crib has been disclosed. Various embodiments of the invention have been described with reference to the figures above. However, one of ordinary skill in the art will recognize that the invention is capable of use in various other combinations, and is capable of change in modifications within the scope of the invention concept expressed here. For instance, although the embodiment of the invention illustrated in FIG. 1 shows a round crib, the conversion from canopy to standard crib described here may also be applied to rectangular cribs. Accordingly, it is intended that all such modifications and/or changes be within the scope of the claims.

What is claimed is:

1. A method of converting a canopy crib to a standard crib, the canopy crib comprising a canopy assembly removably connected to a crib assembly, the canopy assembly comprised of a plurality of canopy legs being removably connected to the crib assembly to support the canopy assembly on top of the crib assembly, the crib assembly having a plurality of respective hollows, a lower portion of each of said canopy legs removably fits inside one of the respective hollows to support the canopy assembly, the method comprising removing the canopy assembly to expose the plurality of respective hollows, and then covering the hollows by inserting a plurality of plugs into said respective hollows, wherein each one of the plugs once inserted in to a respective hollow is substantially flush with a portion of said crib assembly that surrounds said respective hollow.

2. The method of claim 1 wherein the step of removing includes pulling said canopy legs upwards.

3. The method of claim 1 wherein the plugs and respective hollows each have mating non-circular cross sections, each plug once inserted cannot be rotated with respect to a portion of said crib assembly that surrounds said respective hollow.

4. The method of claim 1 wherein each one of the plugs once inserted into a respective hollow cannot be removed using bare fingers.

5. The method of claim 1 wherein the crib assembly includes a plurality of crib legs for supporting said crib assembly, each of the respective hollows being formed in a respective one of the crib legs, a plurality of side members extending upwards from and connected to a base for containing a baby therein, each of the crib legs being connected to at least one of said side members, and none of the crib legs extends more than ⅛ inch above said side members when said canopy assembly has been removed.

6. The method of claim 5 wherein the side members define a curvilinear space for containing the baby in said crib assembly.

7. The method of claim 6 wherein the curvilinear space is substantially a circle.

8. A convertible crib comprising:

a crib assembly having a crib base, a crib side connected to the base and extending upwards therefrom, a plurality of hollows in the crib side, the crib side having five or more vertically elongated bars spaced around the base to prevent a child lying on the base from removing herself therefrom, and a plurality of plugs each to be disposed inside a respective one of said hollows and be substantially flush with a portion of said crib assembly that surrounds said respective hollow; and a canopy assembly having a plurality of canopy legs removably connected to the crib assembly to support the canopy assembly on top of the crib assembly when each of the canopy legs is removably disposed inside a respective one of the hollows.

9. The crib of claim 8 wherein the canopy legs and hollows each have mating non-circular cross sections, each canopy leg once disposed inside the respective one of the hollows cannot be rotated with respect to a portion of the crib assembly that surrounds the respective hollow.

10. The crib of claim 8 wherein the crib assembly further comprises a plurality of crib legs connected to the side for supporting the crib assembly, each respective one of the hollows being formed in a respective one of the crib legs.

11. The crib of claim 10 wherein the side comprises a plurality of side members connected to each other to form the side, each of the crib legs being attached to two adjacent side members.

12. The crib of claim 8 wherein the crib side defines a curvilinear space for containing a child in the crib assembly.

13. The crib of claim 8 wherein the canopy assembly has a dome shaped top.

14. The crib of claim 8 wherein a lower portion of each of the canopy legs fits inside the respective hollow and rests against an inside surface of the respective hollow to support the canopy assembly on top of the crib assembly.

15. A kit of parts for a crib, comprising:

a crib base;

a crib side for being connected to the base to extend upwards therefrom, the crib side having a plurality of hollows therein, the crib side having five or more elongated bars to be spaced around the base when connected thereto to prevent a child lying on the base from removing herself therefrom; and a plurality of plugs each for covering a respective one of the hollows and, when inserted, being substantially flush with a portion of said crib assembly that surrounds said respective hollow.

16. The kit of claim 15 further comprising:

a canopy; and a plurality of canopy legs for being connected to the canopy at one end and for being removably disposed inside a respective one of the hollows near another end.

17. The kit of claim 15 wherein once inserted each plug cannot be rotated with respect to the crib side.

18. The kit of claim 16 wherein each plug once inserted cannot be removed using bare fingers.

19. A crib comprising a crib assembly having a crib base, a crib side connected to the base and extending upwards therefrom, a plurality of hollows in the crib side, the crib side having five or more vertically elongated bars spaced around the base to prevent a child lying on the base from removing herself therefrom, and a plurality of plugs each to be disposed inside a respective one of said hollows and wherein each one of the plugs once inserted into a respective hollow is substantially flush with a portion of the crib side surrounding the respective hollow and cannot be removed using bare fingers; and a canopy assembly having a plurality of canopy legs removably connected to the crib assembly to support the canopy assembly on top of the crib assembly when each of the canopy legs is removably disposed inside a respective one of the hollows.

20. The crib of claim 19 wherein wherein the canopy legs and hollows each have mating non-circular cross sections, each canopy leg once disposed inside the respective one of the hollows cannot be rotated with respect to a portion of the crib assembly that surrounds the respective hollow.

21. The crib of claim 19 wherein each plug has a non-circular cross section that mates with a corresponding cross section of a respective hollow.

22. A kit of parts for a crib, comprising a crib base;

a crib side for being connected to the base to extend upwards therefrom, the crib side having a plurality of hollows therein, the crib side having five or more elongated bars to be spaced around the base when connected thereto to prevent a child lying on the base from removing herself therefrom; and a plurality of plugs each for covering a respective one of the hollows and, wherein each one of the plugs once inserted into a respective hollow is substantially flush with a portion of the crib side surrounding the respective hollow and cannot be removed using bare fingers.

23. The kit of claim 22 wherein once inserted each plug cannot be rotated with respect to the crib side.

24. The kit of claim 22 wherein each plug has a non-circular cross section that mates with a corresponding cross section of a respective hollow.

* * * * *

UNITED STATES PATENT AND TRADEMARK OFFICE

CERTIFICATE OF CORRECTION

PATENT NO. : 6,148,455
DATED : November 21, 2000
INVENTOR(S) : Kasem

It is certified that error appears in the above-identified patent and that said Letters Patent is hereby corrected as shown below:

In the drawings please insert the attached figures 5 and 6.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*